US005711774A

United States Patent [19]

Sheldon

[11] Patent Number: 5,711,774

[45] Date of Patent: Jan. 27, 1998

[54] SILICON CARBIDE ABRASIVE WHEEL

[75] Inventor: David A. Sheldon, Millbury, Mass.

[73] Assignee: Norton Company, Worcester, Mass.

[21] Appl. No.: 727,889

[22] Filed: Oct. 9, 1996

[51] Int. Cl.[6] ..... B24D 3/02

[52] U.S. Cl. ..... 51/307; 51/296; 51/309

[58] Field of Search ..... 51/307, 309, 296

[56] References Cited

U.S. PATENT DOCUMENTS

| | | | |
|---|---|---|---|
| 2,986,455 | 5/1961 | Sandmeyer | 51/296 |
| 3,892,581 | 7/1975 | Burgman et al. | 501/66 |
| 4,086,067 | 4/1978 | Busch et al. | 51/296 |
| 4,259,118 | 3/1981 | Sack | 501/66 |
| 4,623,364 | 11/1986 | Cottringer et al. | 51/309 |
| 4,744,802 | 5/1988 | Schwabel | 51/309 |
| 4,792,535 | 12/1988 | Fine | 501/66 |
| 4,797,269 | 1/1989 | Bauer et al. | 423/600 |
| 4,881,951 | 11/1989 | Wood et al. | 51/309 |
| 4,898,597 | 2/1990 | Hay et al. | 51/309 |
| 4,925,814 | 5/1990 | Fine | 501/66 |
| 4,997,461 | 3/1991 | Markhoff et al. | 51/295 |
| 4,998,384 | 3/1991 | Bouchard et al. | 51/168 |
| 5,009,676 | 4/1991 | Rue et al. | 51/309 |
| 5,035,723 | 7/1991 | Kalinowski et al. | 51/307 |
| 5,035,724 | 7/1991 | Pukari et al. | 501/12 |
| 5,037,453 | 8/1991 | Narayanan et al. | 51/307 |
| 5,064,784 | 11/1991 | Saito et al. | 501/66 |
| 5,090,970 | 2/1992 | Rue et al. | 51/309 |
| 5,094,672 | 3/1992 | Giles et al. | 51/309 |
| 5,095,665 | 3/1992 | Nagata et al. | 51/307 |
| 5,118,326 | 6/1992 | Lee et al. | 51/309 |
| 5,129,919 | 7/1992 | Kalinowski et al. | 51/309 |
| 5,131,923 | 7/1992 | Markhoff-Matheny | 51/293 |
| 5,139,978 | 8/1992 | Wood | 501/127 |
| 5,147,829 | 9/1992 | Hench et al. | 501/12 |
| 5,152,810 | 10/1992 | Rue et al. | 51/309 |
| 5,203,886 | 4/1993 | Sheldon et al. | 51/309 |
| 5,236,483 | 8/1993 | Miyashita et al. | 501/12 |
| 5,268,335 | 12/1993 | Kerko et al. | 501/66 |
| 5,401,284 | 3/1995 | Sheldon et al. | 51/309 |
| 5,536,283 | 7/1996 | Sheldon et al. | 51/309 |

FOREIGN PATENT DOCUMENTS

| | | | |
|---|---|---|---|
| 63-256365 | 10/1988 | Japan . | |
| 458427 | 3/1975 | U.S.S.R. | B24D 3/14 |
| 1168397 | 8/1983 | U.S.S.R. | B24D 3/14 |

*Primary Examiner*—Deborah Jones
*Attorney, Agent, or Firm*—Mary E. Porter

[57] ABSTRACT

A vitreous bonded abrasive grinding wheel comprises silicon carbide abrasive grain, hollow ceramic spheres and a low temperature, high strength bond. The wheel has improved corner or profile holding characteristics and improved mechanical properties and is suitable for grinding non-ferrous materials.

8 Claims, No Drawings

SILICON CARBIDE ABRASIVE WHEEL

BACKGROUND OF THE INVENTION

The invention relates to abrasive tools, particularly abrasive wheels containing silicon carbide abrasive grit and hollow ceramic spheres, having improved resistance to profile loss on the grinding face of the wheel. The invention further includes a vitrified bond composition which provides improved mechanical strength and improved radius holding properties in the silicon carbide abrasive wheels.

New precision moving parts are designed to run at higher outputs with higher efficiencies for longer service periods. These parts include, for example, engines (internal combustion, jet & electric), drive trains (transmissions & differentials), and bearing surfaces. In order to melt these demands, the parts must be produced with improved/quality including better/stronger designs with tighter dimensional tolerances. Lighter weight metals and composites are being used to increase outputs and speed without decreasing efficiencies. To achieve dimensional tolerances, the parts may be produced with more expensive materials to near net or final shape and size.

Grinding wheels are utilized for fabrication of the entire part or to impart the final dimensions. Vitreous is or glass bonded grinding wheels are the wheels utilized most on metal parts. In order to produce these types of precision parts with a grinding wheel, the reverse image of the part is "dressed" into the wheel face with a diamond tool. Because the part being manufactured takes the profile of the grinding wheel, it is important that the grinding wheel retain that shape as long as possible. The ideal grinding wheel produces the precision parts with exact dimensional tolerances and with no material damage.

Typically, the grinding wheels fall out of shape of fail at a corner or a curve in the wheel. The operators of grinding machines may set up dressing of the wheel after every piece to avoid defects, or in the case of creepfeed grinding, continuous dressing; i.e., the diamond dressing tool is in continuous contact with the wheel. With wheels produced using higher performing abrasive grits, the shape change in the corner of the wheel may not appear until after grinding four or five pieces and the operators of the grinding machines may plan on dressing these wheels after grinding three pieces. A reduction in the loss of the grinding wheel through dressing and further reductions in dressing frequency and/or compensation (depth of dress) are desirable goals.

Vitrified bonds characterized by improved mechanical strength have been disclosed for use with sol gel alpha-alumina and conventional alumina oxide abrasive grits in the manufacture of grinding wheels having improved corner holding properties. These bonds are disclosed in U.S. Pat. No. 5,203,886, U.S. Pat. No. 5,401,284 and U.S. Pat. No. 5,536,283, which are hereby incorporated by reference. The bonds may be fired at relatively low temperatures to avoid reaction with high performance, sintered sol gel alpha-alumina abrasive grain. The wheels made with the alumina grains have shown excellent performance in finishing precision moving parts, particularly ferrous metal parts.

Less success has been achieved with non-ferrous parts, such as titanium and lighter weight or softer materials. The alumina oxide grains are known to be less effective in grinding such materials. Silicon carbide grain is effective with these materials, but tends to become excessively oxidized by reaction with bond components during firing, causing excessive shrinkage, frothing or bloating, or coring of the wheel structure. Even at low firing temperatures achievable with the alumina grit corner holding bonds, these bond will react with silicon carbide grain, oxidizing the grain and causing defects in the wheels.

It has now been discovered that by lowering the content of certain reactive oxides in the low temperature vitrified bond, in particular, the lithium oxide, and by formulating a wheel comprising this new bond, hollow ceramic spheres and silicon carbide grain, a superior wheel may be produced without excessive oxidation of the silicon carbide. These wheels are an improvement over vitrified bonded silicon carbide wheels known in the art. These wheels are mechanically strong with resistance to profile loss, and are sufficiently porous to permit debris clearance and to deliver coolant to avoid workpiece surface scratching and burn during grinding. These wheels are suitable for grinding titanium and other light weight metals and composites used in newly developed precision moving parts.

SUMMARY OF THE INVENTION

The invention is an abrasive grinding wheel comprising silicon carbide abrasive grain, about 5 to 21 volume % hollow ceramic spheres, and a vitreous bond wherein the vitreous bond after firing comprises greater than about 50 weight % $SiO_2$, less than about 16 weight % $Al_2O_3$, from about 0.05 to about 2.5 weight % $K_2O$, less than about 1.0 weight % $Li_2O$ and from about 9 to about 16 weight % $B_2O_3$. With these bond components grain oxidation is minimized and the abrasive wheels are characterized by improved corner or profile holding properties, particularly in the grinding of non-ferrous precision moving parts. The abrasive grinding wheel preferably comprises 4 to 15 volume % vitrified bond, having a firing temperature up to 1100° C., 34 to 50 volume % silicon carbide grain, and 30 to 55 volume % porosity.

DESCRIPTION OF THE PREFERRED EMBODIMENTS

The vitrified bonded abrasive tools of the present invention comprise silicon carbide abrasive grain. Also used herein as a pore former, or filler or secondary abrasive, are hollow ceramic spheres. The abrasive tools comprise about 5 to 21 volume % (including the volume of ceramic shell and the volume of the inner void of spheres) hollow ceramic spheres, preferably 7 to 18 volume %. Preferred hollow ceramic spheres for use herein are those comprising mullite and fused silicon dioxide which are available commercially from Zeeland Industries, Inc., under the Z-Light™ tradename in sizes ranging from 10 to 450 microns. While not wishing to be bound by any theory, it is believed that the hollow ceramic spheres preferentially react with the bond components during firing, saving the silicon carbide grain from oxidation. Other hollow ceramic spheres, such as the Extendospheres™ materials available from the PQ Corporation, also are suitable for use herein. Spheres useful in the invention include spheres sized from about 1 to 1,000 microns. Sphere sizes are preferably equivalent to abrasive grain sizes, e.g., 10–150 micron spheres are preferred for 120–220 grit (142–66 micron) grain.

The abrasive wheels of the invention include abrasive, bond, the hollow ceramic spheres and, optionally, other secondary abrasives, fillers and additives. The abrasive wheels of the invention preferably comprise from about 34 to about 50 volume % of abrasive, more preferably about 35 to about 47 volume % of abrasive, and most preferably about 36 to about 44 volume % of abrasive.

The silicon carbide abrasive grain represents from about 50 to about 100 volume % of the total abrasive in the wheel and preferably from about 60 to about 100 volume % of the total abrasive in the wheel.

Secondary abrasive(s) optionally provide from about 0 to about 50 volume % of the total abrasive in the wheel and preferably from about 0 to about 40 volume % of the total abrasive in the wheel. The secondary abrasives which may be sol gel alpha-alumina, mullite, silicon dioxide, cubic boron used include, but are not limited to, alumina oxide, sintered nitride, diamond, flint and garnet.

The composition of the abrasive wheel must contain a minimum volume percentage of porosity to effectively grind materials, such as titanium, which tend to be gummy and cause difficulty in chip clearance. The composition of the abrasive wheel of the invention preferably contains from about 30 to about 55 volume % porosity, more preferably contains from about 35 to about 50 volume % porosity, and most preferably contains from about 39 to about 45 volume % porosity. The porosity is formed by both the spacing inherent in the natural packing density of the materials and by hollow ceramic pore inducing media, such as Z-Light (mullite/fused SiO2) hollow spheres and hollow glass beads. Although some types of organic polymer beads (e.g., Piccotac® resin, or napthalene) may be used with silicon carbide grain in a slow firing cycle, most organic pore formers pose manufacturing difficulties with silicon carbide grain in vitrified bonds. Bubble pore formers are not compatible with the wheel components to thermal expansion mismatch.

The abrasive wheels of the present invention are with a vitreous bond. The vitreous bond used contributes significantly to the improved form holding characteristics of the abrasive wheels of the invention. The raw materials for the bond preferably include Kentucky Ball Clay No. 6, nepheline syenite, flint and a glass frit. These materials in combination contain the following oxides: $SiO_2$, $Al_2O_3$, $Fe_2O_3$, $TiO_2$, CaO, MgO, $Na_2O$, $K_2O$, $Li_2O$ and $B_2O_3$.

The composition of the abrasive wheel preferably contains from about 4 to about 20 volume % bond, and most preferably contains from about 5 to about 15 volume % bond.

After firing the bond contains greater than about 50 weight % $SiO_2$, preferably from about 50 to about 65 weight % $SiO_2$, and most preferably about 60 weight % $SiO_2$; less than about 16 weight % $Al_2O_2$, preferably from about 12 to about 16 weight % $Al_{23}$, and most preferably about 14 weight % $Al_2O_3$; preferably from about 7 to about 11 weight % $Na_2O$, more preferably from about 8 to about 10 weight % $Na_2O$, and most preferably about 8.6 weight % $Na_2O$; less than about 2.5 weight % $K_2O$, preferably from about 0.05 to about 2.5 weight % $K_2O$, and most preferably about 1.7 weight % $K_2O$; less that about 1.0 weight % $Li_2O$, preferably from about 0.2 to about 0.5 weight % $Li_2O$, and most preferably about 0.4 weight % $Li_2O$; less than about 18 weight % $B_2O_3$, preferably from about 9 to about 16 weight % $B_2O_3$, and most preferably about 13.4 weight % $B_2O_3$. The other oxides which are in the vitreous bond such as $Fe_2O_3$, $TiO_2$, CaO, and MgO are impurities in the raw materials which are not essential in making the bond and are present after firing in amounts up to about 1.0 weight % of each oxide.

The abrasive wheels are fired by methods known to those skilled in the art. The firing conditions are primarily determined by the actual bond and abrasives used and the wheel size and shape. For the bonds disclosed herein used with silicon carbide grain, a maximum firing temperature of 1100° C. is required to avoid reaction between the grain and the bond causing damage to the wheels during firing.

After firing the vitrified bonded body may be impregnated in a conventional manner with a grinding aid such as wax, or sulfur, or various natural or synthetic resins, or with a vehicle, such as epoxy resin, to carry a grinding aid into the pores of the wheel. Other additives, such as processing aids and colorants, may be used. Aside from the temperature and composition limitations described above, the wheels, or other abrasive tools, such as stones or hones, are molded, pressed and fired by any conventional means known in the art.

The following Examples are provided by way of illustration, and not by way of limitation.

EXAMPLES

Example 1

Samples were made for testing and comparing the quality of the low firing temperature, low reactivity bond of the invention with a commercial Norton company bond designated for use with silicon carbide abrasives. The new bond had a prefired composition of 42.5 wt % of powdered glass frit (the frit having a composition of 49.4 wt % $SiO_2$, 31.0 wt % $B_2O_3$, 3.8 wt % $Al_2O_3$, 11.9 wt % $Na_2O$, 1.0 wt % $Li_2O$, 2.9 wt % MgO/Ca), and trace amounts of $K_2O$), 31.3 wt % nephelene syenite, 21.3 wt % Kentucky No. 6 Ball Clay, 4.9 wt % flint (quartz). The chemical compositions of nephelene syenite, Kentucky No. 6 Ball Clay and flint are given in Table I.

TABLE I

| Oxide (wt %) | Nephelene Syenite | Kentucky#6 Ball Clay | Flint |
|---|---|---|---|
| $SiO_2$ | 60.2 | 64.0 | 99.6 |
| $Al_2O_3$ | 23.2 | 23.2 | 0.2 |
| $Na_2O$ | 10.6 | 0.2 | |
| $K_2O$ | 5.1 | 0.4 | |
| MgO | | 0.3 | |
| CaO | 0.3 | 0.1 | |
| Impurities | 0.1 | 3.4 | 0.1 |
| Loss on Ignition | 0.4 | 8.7 | 0.1 |

The bond was produced by dry blending the raw materials in a Sweco Vibratory Mill for 3 hours. For the wheels of the invention, the bond was mixed into a mixture of green silicon carbide abrasive grain (60 grit) obtained from Norton Company and Z-Light hollow ceramic spheres (W-1800 grade, 200–450 microns in size) obtained from Zeeland Industries, INC., Australia. This was further mixed with a powdered dextrin binder, liquid animal glue (47% solids) and ethylene glycol as a humectant in a 76.2 cm (30 inch) verticle spindle mixer, equipped with a rotating pan and plow blades, at low speed. The mix was screened through a 14 mesh screen to break-up any lumps. The mix was then pressed into wheels with dimensions of 508×25.4×203.8 mm (20"×1"×8"). The wheels were fired under the following conditions at 40° C. per hour from room temperature to 1000° C. held for 8 hours at that temperature then cooled to room temperature in a periodic kiln. Sample wheels were also made with two of Norton's standard commercial bonds which were produced by dry blending the raw materials in Norton's production facility using standard production processes. The bond was mixed with an abrasive mix. The abrasive mix consisted of abrasive (60 grit green silicon carbide grain) and the other components shown in the formulations given in the table below. The wheels were fired using a production cycle with a firing soak temperature of 900° C.

The bulk density, elastic modulus and SBP (sandblast penetration: hardness measured by directing 48 cc of sand through a 1.43 cm (9/16 inch) diameter nozzle under 7 psi pressure at the grinding face of the wheel and measuring the penetration distance into the wheel of the sand) of the wheels of the invention were comparable to the commercial silicon carbide wheels. Results are shown in Table 2, below. The wheels of the invention showed no bloating, slumping, coring or other defects indicative of silicon carbide oxidation after firing, and were in appearance and visible structure very similar to the commercial controls.

TABLE 2

Wheel Compositions and Test Results

| | Commercial Bond A-1 | Commercial Bond A-2 | Commercial Bond B | Invention Bond |
|---|---|---|---|---|
| Composition of Wheels Wt. % | | | | |
| Abrasive grain | 75.32 | 77.23 | 75.73 | 77.23 |
| Pore Inducer | | | | |
| Z-Light spheres | — | 5.81 | 7.26 | 7.22 |
| Piccotac resin | 6.89 | — | — | — |
| Bond | 12.17 | 12.33 | 12.38 | 12.82 |
| Dextrin | 2.12 | 1.56 | 1.56 | 1.52 |
| Animal Glue | 3.02 | 2.94 | 2.95 | 3.01 |
| Water | 0.54 | — | — | — |
| Ethylene Glycol | 0.21 | 0.12 | 0.12 | 0.12 |
| Composition of Wheels Vol. % | | | | |
| Abrasive Grain | 38.0 | 38.3 | 37.4 | 37.4 |
| Z-Light spheres (shell only) | 0 | 3.7 | 4.6 | 4.6 |
| Z-Light spheres (total volume) | 0 | 11.7 | 14.6 | 14.6 |
| Bond (post-firing) | 8.1 | 8.1 | 8.1 | 8.1 |
| Test Results | | | | |
| Green Density g/cm3 | 1.543 | 1.553 | 1.544 | 1.530 |
| Fired Density g/cm3 | 1.41 | 1.49 | 1.49 | 1.48 |
| Elastic Modulus | 20.0 | 19.0 | 22.2 | 22.5 |
| SBP mm | 3.83 | 5.04 | 4.22 | 3.94 |

Example 2

Abrasive wheels were made for comparing the new silicon carbide wheel bond and composition with (1) the new bond in a silicon carbide wheel composition without hollow ceramic spheres, and (2) Norton Company's low temperature bonds for alumina abrasives (the bonds of U.S. Pat. No. 5,401,284). The wheel compositions are described in Table 3. The bonds and wheels were produced by the same process as described in Example 1, except wheels were 178×25.4×31.75 mm (7×1×1 ¼ inches), a laboratory scale (Hobart N50 dough) mixer was used in place of the verticle spindle mixer, and a 1000° C. soak firing cycle was used. Results are shown in Table 3.

TABLE 3

Wheel Compositions and Test Results

| Composition of Wheels Wt. % | Invention Bond | Invention Bond | Commercial Bond |
|---|---|---|---|
| Abrasive grain | 75.36 | 84.41 | 73.50 |
| Z-Light spheres | 7.64 | 0 | 9.17 |
| Bond | 12.06 | 11.20 | 12.38 |
| Dextrin | 1.91 | 1.47 | 1.88 |
| Animal Glue | 2.91 | 2.79 | 2.94 |
| Ethylene Glycol | 0.12 | 0.13 | 0.12 |
| Composition of Wheels Vol. % | | | |
| Abrasive Grain | 35.42 | 48.00 | 34.50 |
| Z-Light spheres (shell only) | 4.6 | 0 | 5.5 |
| Z-Light spheres (total sphere) | 14.6 | 0 | 17.5 |
| Bond | 7.2 | 8.1 | 7.2 |
| Test Results | | | |
| Green Density g/cm3 | 1.459 | 1.751 | 1.456 |
| Bulk Density g/cm3 | | | |
| Target | 1.395 | 1.698 | 1.389 |
| Actual | 1.43 | Indeterminate | 1.45 |
| Shrinkage Vol. % | 2.9 | Swelling & Surface Froth | 5.0 |
| SBP mm | 4.35–4.62 | Indeterminate | 3.20–3.26 |

In contrast with the wheels of the invention, the silicon carbide wheels made with hollow ceramic spheres and the low temperature bond for alumina abrasives demonstrated unacceptable shrinkage (i.e., in excess of 4 volume %). Silicon carbide wheels made with the new bond, but without hollow ceramic spheres also demonstrated an unacceptable degree of slumpage, surface "froth" and blistering, indicating bond reactions with the grain during firing in both instances. Bond reaction with grain was apparently absent from the wheels of the invention. Thus, to make the silicon carbide wheels of the invention, the wheel composition must contain both hollow ceramic spheres and the new low temperature bond having reduced chemical reactivity with the grain.

Example 3

The abrasive wheels of Example 1 were tested for radial wear of the new bond and compared with the commercial bond control wheels.

After firing, the wheels made with the new bond comprised about 42 vol. % grain (a combination of the silicon carbide and the ceramic shell of the Z-Light bubbles), about 8.1 vol. % bond and about 49.9 vol. % porosity (a combination of natural porosity and the inner volume of the Z-Light bubble induced porosity).

The commercial abrasive wheels were tested along with wheels made with the new bond (all wheels contained 8.1 vol. % fired bond) in continuous dress creepfeed grinding of titanium blocks.

The conditions of the grinding tests were as follows:

Grinding Machine: Blohm #410 PROFIMAT

Wet Grinding: 10% Trim MasterChemical™ VHP E200 with water

Workpiece Material Ground: Titanium blocks

Workpiece Part size: 159×102 mm

Width of Cut: 25.4 mm

Depth of Cut: 2.54 mm

Corner Radius of Grinding Wheel: face dressed straight (no radius imposed)

Table Speed: 2.12 mm/s; 3.18 mm/s; or 4.23 mm/s
Wheel Face Dressed: continuous dressing of wheel at 0.76 microns/revolution
Wheel Speed: 23 m/s (4,500 sfpm) 860 rpm
Number of Grinds per Test: 2 grinds per table speed The radial wear was measured by grinding a tile coupon after each grind to obtain the profile of the wheel. Coupons were traced on an optical comparator with a magnification of 50×. Radial wear (average corner radius in microns) from the trace is measured as the maximum radial wear with a caliper. Results are shown below.

TABLE 4

| | Wheel Radial Wear Test Results | | | |
|---|---|---|---|---|
| Test Results | Commercial Bond A-1 | Commercial Bond A-2 | Commercial Bond B | Invention Bond |
| Power Watts/mm Table Speed | | | | |
| 2.12 mm/s | 278 | 252 | 287 | 299 |
| 3.18 mm/s | 390 | 332 | 386 | 421 |
| 4.23 mm/s | 482 | 373 | 463 | 505 |
| Normal Force N/mm Table Speed | | | | |
| 2.12 mm/s | 8.2 | 7.4 | 8.4 | 8.8 |
| 3.18 mm/s | 11.4 | 10.0 | 11.7 | 12.1 |
| 4.23 mm/s | 13.8 | 11.0 | 13.4 | 14.6 |
| Exit Waviness microns Table Speed | | | | |
| 2.12 mm/s | 9.4 | 10.2 | 9.9 | 9.7 |
| 3.18 mm/s | 9.4 | 9.9 | 9.1 | 9.7 |
| 4.23 mm/s | 13.5 | 10.4 | 8.1 | 10.4 |
| Corner Radius Table Speed | | | | |
| 2.12 mm/s | 409 | 658 | 484 | 382 |
| 3.18 mm/s | 842 | 1129 | 806 | 566 |
| 4.23 mm/s | 1073 | 2248 | 1169 | 1097 |

From this grinding test, one can conclude the silicon carbide grain wheels, when used with the new bond and hollow ceramic spheres of the invention, have improved mechanical strength with resistance to loss of wheel profile and acceptable surface finish, power draw and grinding force relative to conventional silicon carbide wheels.

It is understood that various other modification will be apparent to and can be readily made by those skilled in the art without departing from the scope and spirit of the present invention. Accordingly, the scope of the claims is not limited to the description set forth above but rather encompasses all patentable features of the invention, including all features which would be treated as equivalents thereof by those skilled in the art to which the invention pertains.

I claim:

1. An abrasive grinding wheel comprising silicon carbide abrasive grain, about 5 to 21 volume percent hollow ceramic spheres, and a vitreous bond, wherein the vitreous bond after firing comprises, on a weight percentage basis, greater than about 50% $SiO_2$, less than about 16% $Al_2O_3$, from about 0.05 to about 2.5% $K_2O$, less than about 1.0% $Li_2O$ and from about 9 to about 16% $B_2O_3$.

2. The wheel of claim 1, wherein the hollow ceramic spheres comprise fused mullite and silicon dioxide.

3. The wheel of claim 2, wherein the hollow ceramic spheres have a size of about 1 to 1000 microns.

4. The wheel of claim 2, wherein the wheel comprises about 34 to 50 volume percent silicon carbide abrasive grain.

5. The wheel of claim 1, wherein the wheel comprises from about 4 to about 20 volume percent vitreous bond.

6. The wheel of claim 1, wherein the wheel comprises from about 30 to about 55 volume percent porosity.

7. The wheel of claim 1, wherein the vitreous bond after firing comprises, on a weight percentage basis, about 55 to about 65% $SiO_2$, about 12 to about 16% $Al_2O_3$, and less than 0.5% $Li_2O$.

8. A method of fabricating an abrasive tool for grinding non-ferrous materials comprising the steps:

a) providing a vitreous bond mixture wherein the vitreous bond mixture produces a vitreous bond after firing comprising, on a weight percentage basis, greater than about 50% $SiO_2$, less than about 16% $Al_2O_3$, from about 0.05 to about 2.5% $K_2O$, less than about 1.0% $Li_2O$ and from about 9 to about 16% $B_2O_3$;

b) adding the vitreous bond mixture to a mixture comprising silicon carbide abrasive grain and hollow ceramic spheres;

c) molding the abrasive tool components; and d) firing the molded abrasive tool components without exceeding a temperature of 1100° C. to form the abrasive tool;

whereby the abrasive tool and is substantially free of visible evidence of oxidation of the silicon carbide grain.

* * * * *